United States Patent [19]

Honda et al.

[11] Patent Number: 4,639,417

[45] Date of Patent: Jan. 27, 1987

[54] SILVER HALIDE X-RAY PHOTOSENSITIVE MATERIAL

[75] Inventors: Chika Honda; Akio Suzuki; Katsutoshi Machida, all of Hachioji; Masatoshi Iwata, Akishima, all of Japan

[73] Assignee: Konishiroku Photo Industry Co., Ltd., Japan

[21] Appl. No.: 694,833

[22] Filed: Jan. 25, 1985

[30] Foreign Application Priority Data

Jan. 27, 1984 [JP] Japan ..... 59-13955
Jan. 30, 1984 [JP] Japan ..... 59-15535

[51] Int. Cl.[4] ..... G03C 1/02

[52] U.S. Cl. ..... 430/567; 430/564; 430/569; 430/966; 430/967

[58] Field of Search ..... 430/495, 496, 564, 567, 430/569, 966, 967

[56] References Cited

U.S. PATENT DOCUMENTS

| | | | |
|---|---|---|---|
| 3,942,986 | 3/1976 | Florens | 430/567 |
| 4,177,071 | 12/1979 | DeBrabandere et al. | 430/966 |
| 4,425,426 | 1/1984 | Abbott et al. | 430/502 |
| 4,446,228 | 5/1984 | Honda et al. | 430/567 |

*Primary Examiner*—Won H. Louie
*Attorney, Agent, or Firm*—Finnegan, Henderson, Farabow, Garrett & Dunner

[57] ABSTRACT

A silver halide X-ray photosensitive material has a support bearing thereon a silver halide emulsion layer. The layer has at least three kinds of silver halide emulsions whose photographic characteristics are substantially different from each other. Out of at least three kinds of the silver halide emulsions, at least one of them is a monodisperse emulsion $E_1$ and at least another one of them is a polydisperse emulsion $E_2$.

7 Claims, 5 Drawing Figures

GRAIN SIZE DISTRIBUTION
OF SAMPLE NO.19

SILVER HALIDE X-RAY PHOTOSENSITIVE MATERIAL

BACKGROUND OF THE INVENTION

1. Field of the Invention

This invention relates to a silver halide X-ray photosensitive material for medically diagnostic use, and more particularly to a silver halide X-ray photosensitive material having a wide exposure latitude in a specific region of the characteristic curve thereof and is so sharp as to be convenient for medical diagnoses, and still more particularly to the so-called direct X-ray photographic film.

2. Description of the Prior Art

When X-ray photographing the regions of an organism with a silver halide X-ray photosensitive material (hereinafter simply called an X-ray photosensitive material), a high order of diagnosing capability is required for early finding a nidus and for avoiding a diagnostic error. However, the conventional X-ray photosensitive materials cannot always satisfy these requirements.

To be concrete, the conventional direct X-ray photosensitive materials are roughly classified into (a) a high-gamma type, (b) a low-gamma type and (c) a medium-gamma type. The high-gamma type materials are, substantially poor in the information contents in a low exposure area, though the sharpness thereof is relatively good; the low-gamma type materials (b) are, on the contrary, poor in sharpness, though the information contents in the low exposure area are aboundant, so that it is hard to diagnose; and the medium-gamma type materials (c) are merely an average in the sharpness as well as in the information contents in the low-exposure area.

On the characteristic curves drawn when the above-mentioned types of direct X-ray photosensitive materials were processed in the undermentioned processing conditions, $\gamma_1$ and $\gamma_2$ were obtained at the points of optical density of 0.50 and 1.50, and at the points of optical density of 0.05 and 0.30, respectively. The typical examples of the $\gamma_1$ and $\gamma_2$ are shown in the following Table-1:

[Processing Conditions]

Each type of the materials is to be processed with a roller-transport type automatic processor, New QX-1200, manufactured by Konishiroku Photo Ind. Co., Ltd. Japan, by making use of Developer-1 given below and by following the steps mentioned below:

| Developing Step | Temperature | Time |
|---|---|---|
| Developing | 35° C. | 30 sec. |
| Fixing | 34° C. | 20 sec. |
| Washing | 33° C. | 18 sec. |
| Drying | 45° C. | 22 sec. |

| Developer | |
|---|---|
| Potassium sulfite | 55.0 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenztriazole | 0.04 g |
| 5-nitrobenzimidazole | 0.11 g |
| 1-phenyl-5-mercaptotetrazole | 0.015 g |
| Glutaraldehyde bisulfite | 15.0 g |
| Glacial acetic acid | 16.0 g |

-continued

| | |
|---|---|
| Potassium bromide | 4.0 g |
| Add water to make | 1.000 cc |

| Fixer |
|---|
| SAKURA Acid Hardening Fixer, XF, manufactured by Konishiroku Photo Ind. Co., Ltd., Japan. |

TABLE 1

| | $\gamma_1$ (D = 0.50–1.50) | $\gamma_2$ (D = 0.05–0.30) |
|---|---|---|
| High-gamma type | 2.6–3.0 | 0.83–0.96 |
| Medium-gamma type | 2.4–2.7 | 0.73–0.82 |
| Low-gamma type | 2.0–2.2 | 0.68–0.72 |

There are some instances where the following serious faults or disadvantages are practically experienced in X-ray photographing with the conventional types of direct X-ray photosensitive materials. Namely, a region of an organism most frequently X-rayed is chest, and the important parts for chest X-ray reading are blood vessels in lung fields and coronary artaries behind a heart.

Lung fields are in a medium-density area (D=1.3–1.5) and a high sharpness is required for reading the blood vessels in the lung fields, and coronary arteries are in a low-density area (D=0.05–0.30), and a wide latitude is required for reading.

Conventional X-ray photosensitive materials of high-gamma type do not contribute substantially to the efficiency of diagnoses because they take the coronary arteries only in extremely low density though they take lung fields sharply. On the contrary, when using those of low-gamma type, the lung fields are taken unsharply, though the coronary arteries are taken reasonably.

As for the methods of avoiding such disadvantages to diagnoses as mentioned above, there is a method of using a double-gamma type of X-ray photosensitive materials in which two kinds of polydisperse emulsions each having the different gradation (i.e., gamma; $\gamma$), and the method is naturally limited in the discretionary control of the characteristic curve thereof. In addition, there is a proposal of constituting a characteristic curve of which the low, midium and high density regions are regulated by three kinds of emulsions each different in photographic characteritics, and in this proposal, the characteristic curve may be controlled fairly. However, if two or more kinds of such polydisperse emulsions are used in combination, the value of $\gamma$ is so sharply lowered that it can hardly be put in practical use if it is anything of medical X-ray photosensitive materials.

On the other hand, there is another proposal of preventing a $\gamma$-value of a mixed emulsion from lowering, by the mixture of monodisperse emulsions. In this proposed method, it is found that there are such problems as that the information contents in the low-density region of a characteristic curve are substantially less, that is, the $\gamma$-value is raised excessively and the exposure latitude of the low-density region is narrowed, and any smooth characteristic curve cannot be obtained.

In the industry skilled in the art, it is well-known that the larger the sizes of high-speed silver halide grains of a photographic light-sensitive material are, the more a desensitization is freqently caused under a mechanical pressure prior to an exposure to light, that is, a pressure desensitization. With a medical X-ray film, for example, a pressure desensitization is apt to occur, while being handled, by such a crease as the so-called knick mark, because of the large film-sizes. Further in recent years, as for a medical X-ray photographic system, an automatic exposing and processing apparatus equiped with a mechanical transport means are popularly used. In such an apparatus, it is hardly avoided to affect films by a mechanical force. Especially in a dry condition such as winter-time, there frequently cause a pressure desensitization. When causing such a phenomenon in some place, there may be a danger of making an doctor erroneously diagnose and getting the doctor and his patient into a serious trouble.

With the purpose of improving such pressure desensitization as mentioned above, U.S. Pat. Nos. 2,628,167, 2,759,822, 3,445,235 and 2,296,204 disclose the silver halide photosensitive materials such as those using a silver halide emulsion containing thallium or those using dyes. They are, however, not satisfactorily improved and are seriously stained with the dyes, and it can hardly say that the other ones are always capable of satisfactorily displaying the characteristics of silver halide photosensitive materials mainly utilizing an ordinary and high surface-sensitivity of silver halide grains having a large average grain size.

On the other hand, many attempts are made to improve such pressure desensitization by changing the physical properties of the binders of silver halide photographic light-sensitive materials. For example, those attempts are described in U.S. Pat. Nos. 3,536,491, 3,775,128, 3,003,878, 2,759,821 and 3,772,032. With those technique, however, any fundamental improvement cannot be attained, even though the pressure desensitization may be improved, because the surface of a film becomes sticky and the physical properties of binders such as the dryness, scratches and the like are deteriorated seriously.

SUMMARY OF THE INVENTION

Objects of the Invention

It is an object of the invention to provide an X-ray photosensitive material which is high in definition, wide in the exposure latitude of the low-density area thereof and high in diagnosing capability.

Another object of the invention is to provide an X-ray photosensitive material in which a pressure desensitization is improved.

Constitution of the Invention

The present inventors found that an X-ray photosensitive material capable of displaying the photographic characteristics which are fit for the objects can reproducibly and easily be prepared by using in combination at least three kinds of silver halide emulsions containing a polydisperse and monodisperse emulsions and having different photographic characteristics from each other. That is to say, such X-ray photosensitive material of the invention characteristically comprises at least three kinds of silver halide emulsions having substantially different photographic characteristics from each other and out of the three kinds thereof at least one is a monodisperse emulsion $E_1$ and at least one is a polydisperse emulsion $E_2$. The objects of the invention can be achieved by the above-mentioned constitution.

DETAILED DESCRIPTION OF THE INVENTION

Figure 1:
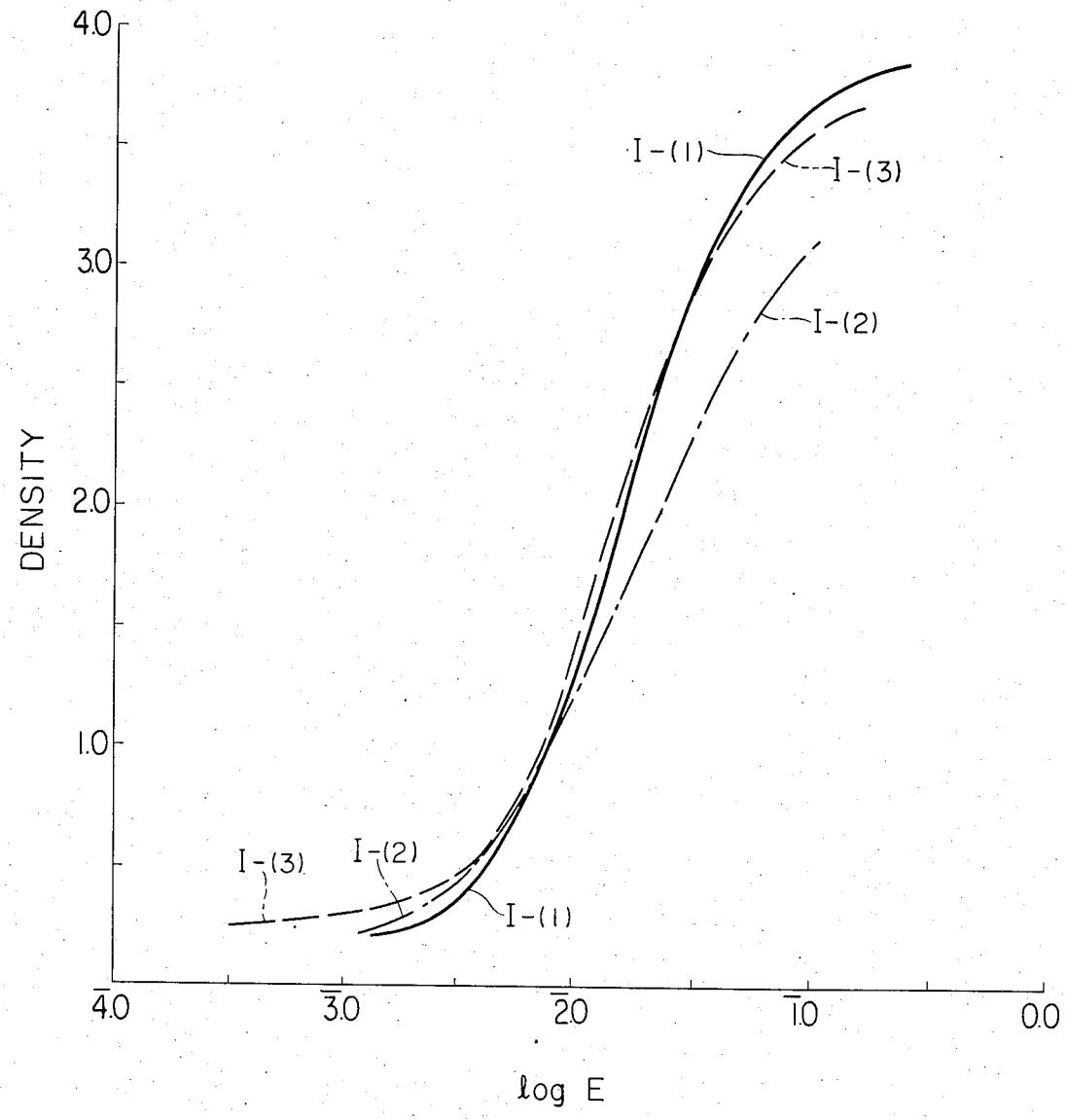
FIG. 1 shows the characteristic curves of the samples prepared in Example-1.

In this invention, it may be allowed to use more than three kinds of emulsions having different photographic characteristics from each other. It is however practically good enough to use three kinds of them and it is therefore good enough to use a single kind each of monodisperse emulsion $E_1$ and polydisperse emulsion $E_2$ out of the three kinds of them. The rest one may be selected from the disperse emulsions according to the characteristics of the above-mentioned two kinds of emulsions $E_1$, $E_2$.

In this invention, the words, "substantially different photographic characteristics", mean that out of the photographic characteristics including sensitivity, gradation, color sensitivity, color rendering property, developability, image-sharpness, graininess and the like, at least the sensitivity and the gradation are different from each other.

Monodisperse emulsion $E_1$ to be used in this invention is a silver halide emulsion of which at least 80% and more preferably 95% of the grains thereof by number or weight are in a size within ±40% and more preferably ±30% of the average grain size, when the average grain size is measured in the following method reported by Trivelli and Smith.

A further preferable monodisperse emulsion $E_1$ of the invention is that of the variation coefficient of grain sizes of not more than 0.20. An average grain size r can be obtained in the following formula;

$$\bar{r} = \frac{\Sigma\, ni\, ri}{\Sigma\, ni}$$

in which the diameter r of the grains of an emulsion is divided into n sections and a grain size and grain number belonging to the first section of n sections are designated by ri and ni, respectively. Further a standard deviation value s can generally be obtained in the following formula;

$$s = \sqrt{\frac{\Sigma\, (\bar{r} - ri)^2\, ni}{\Sigma\, ni}}$$

and a variation coefficient VC can be obtained in the following formula;

$$VC = \frac{s}{\bar{r}}$$

Consequently, a monodispersibility to be determined for the emulsions relating to this invention is formulated as $s/\bar{r} \leqq 0.20$.

Monodisperse silver halide emulsions preferably be used in this invention comprise substantially the so-called regular-crystal emulsions. The term, regular-crystal emulsion means an emulsion substantially comprising crystallized grains in a regular form such as a cube, octahedron, tetradecahedron, dodecahedron, sphere or the like. For example, these regular-crystal emulsions are described in T. H. James, "The Theory of the Photographic Process", 5th edition, published by MacMillan Publication Co., Inc., p. 22.

In this invention, the regular-crystal emulsions include those rounded off by a silver halide solvent or the like to such a degree that the original form before rounding is recognizable.

In addition, the term, "polydisperse" means a state where at least 10% by number or weight of distributed grains are varied by 40% in size from the average grain size when measuring the average grain size in such an ordinary method as reported by Trivelli and Smith in "The Photographic Journal", No. 79, 1939, pp. 330–338. Emulsions of which 25% of the grains at the most are varied in size from the average grain size may preferably be used in this invention.

Polydisperse silver halide emulsion $E_2$ which is preferably used in this invention substantially comprises the so-called twinned crystals.

Such twinned crystal emulsions are in the tabular, bar, or irregular form, and substantially comprise crystallized grains having twinned planes. In this invention, they also include those rounded off to the same extent as described above. For example, these twinned crystals are also described in "The Theory of the Photographic Process", p. 22.

Further, the grain shape and its sizes can be observed by the use of an electron micrographic means or the grain sizes can be obtained by the use of a centrifuge type Stokes' diameter measuring instrument.

A gradient $\gamma$ is generally determined in the manner that a characteristic curve is drawn on a rectangular coordinates system of which the coordinate axes of optical density D and exposure logarithm log E are graduted with the same unit degrees, and thereon a gradient $\gamma$ is determined by a tan 0 of angle 0 made between a straight line connected between two points on the characteristic curve and the axis of log E.

In this invention, an X-ray photosensitive material in which a pressure desensitization is improved by at least three kinds of emulsions containing monodisperse emulsion $E_1$ and polydisperse emulsion $E_2$, in the case that a value of gamma $\gamma_1$ determined by the effective density points of 0.50 and 1.50 on a characteristic curve is from 2.7 to 3.3 and a value of gamma $\gamma_2$ determined by the effective density points of 0.05 and 0.30 is from 0.36 to 0.65, and the characteristic curves mentioned in this invention are drawn on a rectangular coordinates system on which the same unit degrees of optical density D and exposure logarithm log E are graduated on the respective coordinate axis.

On the characteristic curve, the above-mentioned $\gamma_1$ means an inclination of a straight line connected between a point of a base (support) density+a fog density+effective density 0.50 and a point of the base density+the fog density+effective density 1.50, and the above-mentioned $\gamma_2$ means an inclination of a straight line connected between a point of the base density+the fog density+effective density 0.05 and a point of the base density+the fog density+effective density 0.30.

In a numerical expression, $\gamma_1$ and $\gamma_2$ mean tan $0_1$ and tan $\theta_2$, respectively, provided that the angles made between the straight lines and the axes of exposure (i.e., the axes of abscissas) represent $\theta_1$ and $\theta_2$, respectively.

In this invention, the above-mentioned polydisperse emulsion $E_2$ has the highest speed among the at least three emulsions used in combination, and it is in charge of the toe portion of a characteristic curve, that is, it is in charge of an effective density of from 0 to 0.6 which is obtained by deducting a fog density and a base density from a density measured, or it is in charge of the effective density zero up to 25% of a maximum effective density on the characteristic curve.

Under the conditions of an ordinary process such as Processing Conditions N in which the above-mentioned emulsion $E_2$ is so coated independently as to be in a regular thickness (i.e., the emulsion $E_2$ is coated so as to be 2.5 to 3.5 in a maximum effective density), the proper gamma value $\gamma_0$ thereof is from 1 to 3, and the average grain size thereof is of the order of 0.8 to 3 $\mu$m, preferably 1 to 3 $\mu$m.

In this invention, on the other hand, monodisperse emulsion $E_1$ has a medium speed among the at least three emulsions used in combination, and according to the above-mentioned definition, the proper gamma value $\gamma_0$ thereof is from 3 to 5, and the average grain size thereof is of the order of 0.5 to 2 $\mu$m. It is preferred that such a monodisperse emulsion may chiefly be in charge of from 20% to 80% of a maximum value of an effective density on a characteristic curve.

In this invention, other emulsion having relatively minimal speed which is in charge of a maximum effective density portion of the characteristic curve is used. To be concrete, this emulsion is in charge of a portion having not less than 50% of a maximum effective density or a portion having an effective density of not less than 1.20. Such emulsion may be so selected as to be suitable for the requirements for the characteristics, no matter what is selected from either monodisperse emulsions or polydisperse emulsions. A value of $\gamma_0$ is from 3 to 5 if it is a monodisperse emulsion, and from 1 to 3 if it is polydisperse emulsion. The average grain size of them is from 0.3 to 0.8 $\mu$m.

Providing that the speed of a medium speed emulsion, i.e., a monodisperse silver halide emulsion $E_1$ is regarded as 100, the ratios to the speeds of every emulsion are as follows:

Polydisperse silver halide emulsion $E_2$:
monodisperse silver halide emulsion $E_1$:
other emulsions=(140–300):100:(50–80)

Further, providing that the speed of the above-mentioned monodisperse silver halide emulsion is regarded as 100, the speed of polydisperse silver halide emulsion is preferably from 110 to 300.

[Processing Conditions N]

(1) How to exposure

A photosensitive emulsion layer is coated over the both surfaces (or one surface) of the transparent base (support) of an X-ray photosensitive material so as to be 2.5 to 3.5 in a maximum effective density. The X-ray photosensitive material is sandwiched between two pieces of optical wedge adjusting the density inclination to be synmetric mirror-reflectionwise, and is then exposed to light of 5400° K. in the same quantity from both sides at the same time for one tenth of a second.

(2) How to process a. Steps processing is made with the following developer and a roller-transport type automatic processor, a New QX-1200 Model, manufactured by Konishiroku Photo Ind. Co., Ltd., Japan, and according to the following steps:

| | Temperature | Time |
|---|---|---|
| Developing step | 35° C. | 30 sec. |
| Fixing step | 34° C. | 20 sec. |
| Washing step | 33° C. | 18 sec. |
| Drying step | 45° C. | 22 sec. |

b. Processing liquids

| Developer | |
|---|---|
| Potassium sulfite | 55.0 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenztriazole | 0.04 g |
| 5-nitrobenzimidazole | 0.11 g |
| 1-phenyl-5-mercaptotetrazole | 0.015 g |
| Glutaraldehyde bisulfite | 15.0 g |
| Glacial acetic acid | 16.0 g |
| Potassium bromide | 4.0 g |
| Add water to make | 1.000 cc |

Fixer

Acid hardening fixer, Sakura XF, manufactured by Konishiroku Photo Ind. Co., Ltd., Japan In the invention, any desired characteristic curve can almost freely be obtained by controlling the speeds and proper gamma values of at least three kinds of the emulsions mentioned above as well as by controlling the ratios of the quantity of emulsions used to each other, the thickness thereof and the like.

As for a composition of a silver halide of emulsions relating to this invention, anyone of silver bromide, silver iodobromide and silver iodobromochloride may be used and among them silver iodobromide is preferably used. The silver iodide content thereof is not more than 10 mol % and is preferably from 0.1 to 6 mol %.

It may also be allowed to dope these silver halides with a veriety of metal salts for adjusting photographic characteristics, such as an iridium salt for improving photoflash exposure characteristics, a rhodium salt for adjusting speeds and gamma values, a thallium salt for improving pressure resistance, and the like.

Polydisperse emulsions $E_2$ relating to this invention can be prepared in any publicly known process. They can be prepared by applying such a process as a neutral process, an acid process, an ammonia process, a normal precipitation process, a reverse precipitation process, a double-jet process, a controlled double-jet process, a conversion process, a core/shell process, or the like described in, for example, T. H. James, "The Theory of the Photographic Process", 4th edition, published by Macmillan Publishing Co., Inc., 1977, pp. 38–104, and the like.

Other examples of polydisperse emulsions $E_2$ of this invention include a silver halide emulsion comprising tabular shaped silver halide grains of which grain size is not less than five times as thick as the grain thickness.

Such tabular shaped silver halide grains can be prepared in any process publicly known in the industry skilled in the art.

For example, as described in Hidemaru Sakai's doctoral thesis, "Studies on the Preparation Processes of Photodevelopment Type Silver Halide Photosensitive Materials", published in October, 1960, and available at the Japan National Library, there is a known process in which small tabular shaped grains prepared at a high pBr value are added with ungrown fine grains precipitated under the same conditions so that the ungrown fine grains may be grown.

There are also known processes such as a process described in, for example, Japanese Patent Publication Open to Public Inspection (hereinafter called Japanese Patent O.P.I. Publication) No. 113928/1983, in which, in the initial stage, grains in a reactor, do not substantially contain any iodide ion and the preparation thereof is made at a pBr value of from 0.6 to 1.6, and then they are grown by adding a silver salt, a bromide or an iodide; and such a process as described in Japanese Patent O.P.I. Publication No. 127921/1983 in which tabular shaped grains are formed, in a pBr atmosphere of not more than 1.3, into seed crystals in which the tabular shaped grains are present in the quantity of not less than 40% by weight, so that the seed crystals are grown while the pBr value is being kept in the previous degree and at the same time the solutions of silver and a halogen is being added thereto.

When preparing a monodisperse emulsion $E_1$ relating to this invention, it is desired to accelerate the rates of adding a water-soluble silver salt and a water-soluble halide as the silver halide grains are grown. If such adding rates are accelerated, the grain size distribution may further be monodispersed and the mixing time may also be shortened. Accordingly, these facts lead to advantages in an industrial production and are also favorable from the point of view that the possibilities of the structural defects caused in silver halide grains may be reduced.

Processes of accelerating the adding rate include the processes such as disclosed in Japanese Patent Examined Publication Nos. 36890/1973 and 16364/1977 and Japanese Patent O.P.I. Publication No. 142329/1980 in which the rates of adding an aqueous solution of a silver salt and an aqueous solution of a halide may be allowed to accelerate continuously or stepwise. The rate of an adding flux just before new nuclear grains are produced is allowed to serve as the highest limit of the above-mentioned adding rates. The values of such a highest limit are varied according to a temperature, pH, pAg, agitation degree, compositions of silver halide grains, solubility, grain sizes, distance between grains, protective colloids and the density thereof, and the like.

The processes of preparing the monodisperse emulsions $E_1$ relating to this invention are publicly known. For example, they are described in "Journal of Photographic Science", 12, pp. 242–251, 1963, Japanese Patent Examined Publication Nos. 36890/1973 and 16364/1977, Japanese Patent O.P.I. Publication Nos. 142329/1980 and 179835/1982, and U.S. Pat. No. 4,026,668.

Silver halides to be used in the invention may also be of core/shell type.

These silver halides may chemically be sensitized with chemical sensitizers independently or in combination, including for example, a sulfur sensitizer such as sodium thiosulfate, thiourea and the like; a noble metal sensitizer such as a gold sensitizer including a gold acid chloride, gold trichloride and the like, a palladium sensitizer such as palladium chloride, palladium acid chloride and the like, a platinum compound, an iridium compound, and the like; a selenium sensitizer such as selenious acid, selenourea and the like; a reduction sensitizer such as stannous chloride, a polyamine including diethylenetriamine, thiourea dioxide, a sulfite, silver nitrate and the like. A variety of sensitizing dyes and other additives may be added thereto so as to answer to the purposes. Wherein, such a technique or the like as described in "Research Disclosure" Nos. 17643 and 18431 may be applied thereto.

At least three kinds of emulsions to be used in this invention may be used in the mixture or laminated independently.

When chemically sensitizing a silver halide emulsion $Em_2$ of this invention for toe portion of a characteristics curve, (which is preferably a polydisperse emulsion $E_2$ of this invention) and a silver halide emulsion $Em_1$ of this invention for a medium density portion (which is preferably a monodisperse emulsion $E_1$ of this invention), there are two processes, that is, one process in which the respective emulsions are chemically sensitized separately under optimum conditions, and another process in which after mixing up the two emulsions, the mixture is chemically sensitized. The preferable process is the former.

Photosensitive materials of this invention can be variously constructed. For example, (1) the above-mentioned silver halide emulsion $Em_2$ for a toe portion and silver halide emulsion $Em_1$ for a medium density portion are mixed up in an appropriate proportion, and the mixture thereof is coated on a base (support), and a protective gelatin-layer is then provided thereon. The coated layer is allowed to contain a remaining emulsion of this invention; (2) silver halide emulsion $Em_1$ for a medium density portion is coated to be a layer on a base and silver halide emulsion $Em_2$ for a toe portion is provided thereon to be a layer, and a protective gelatin-layer is further provided thereon. Either $Em_1$ or $Em_2$ is allowed to contain a remaining emulsion of this invention; (3) silver halide emulsion $Em_2$ for a toe portion is coated to be a layer on a base and silver halide emulsion $Em_1$ for a medium density portion is coated thereon to be a layer, and a protective gelatin-layer is further coated thereon. Either $Em_1$ or $Em_2$ is allowed to contain a remaining emulsion of this invention; or (4) In the above-mentioned constructions from (1) through (3), a dye-layer is provided between the base and the emulsion layer so that any crossover rays can be cut.

The silver halide weight proportion of silver halide emulsion $Em_2$ for a toe portion to silver halide emulsion $Em_1$ for a medium density portion to be used in this invention is preferably from 3:97 to 35:65 and more preferably from 5:95 to 25:75.

At least three kinds of silver halide emulsions of this invention are to be used in silver halide photographic photosensitive materials for X-ray photographic use. When these three kinds of emulsions are a high-speed emulsion (i.e., a polydisperse emulsion $E_2$), a medium-speed emulsion (i.e., a monodisperse emulsion $E_1$), and a low-speed emulsion (i.e., either of a polydisperse emulsion and a monodisperse emulsion may be used), the content ratio by weight of these emulsions is 10–120:100:10–90 and preferably 30–100:100:50–80, respectively.

How to laminate such emulsion layers may be determined, taking the speed, coating thickness, developability, light permeability and the like of each emulsion into consideration.

Hydrophilic colloids to be used independently or in combination in relation to this invention include not only gelatin but also a variety of gelatin derivatives such as a gelatin derivative prepared by the interaction of gelatin and an aromatic sulfonyl chloride, an acid chloride, an acid anhydride, an isocyanate, an 1,4-diketone, a gelatin derivative prepared by the interaction of gelatin and a trimellitic acid anhydride, a gelatin derivative prepared by the interaction of gelatin and an organic acid containing an active gelatin, a gelatin derivative prepared by the interaction of gelatin and an aromatic glycidyl ether, a gelatin derivative prepared by the interaction of gelatin and maleimide, maleamic acid, an unsaturated aliphatic diamide or the like, a sulfalkylated gelatin, a polyoxyalkylated gelatin derivative, a high polymer grafted gelatin, a synthetic hydrophilic high polymer substance, and a natural hydrophilic high polymer substance other than gelatin, such as casein, agar, and an alginic polysaccharide.

Emulsions relating to this invention may be added with a variety of popular additives so as to meet the purposes. These additives include, for example, a stabilizer or an antifoggant such as an azaindene, a triazole, a tetrazole, an imidazolium salt, a tetrazolium salt, a polyhydroxy compound and the like; a hardener such as those of an aldehyde, an aziridine, an inoxazole, a vinyl sulfone, an acryloyl, an albodiimide, a maleimide, a methanesulfonic acid ester, a triazine and the like; a development accelerator such as benzyl alcohol, a polyoxyethylene compound and the like; an image stabilizer such as those of a chroman, a coumaran, a bisphenol, and a phosphorous acid ester; and a lubricant such as a wax, a glyceride of a higher fatty acid, a higher alcohol ester of a higher fatty acid; and the like. There can also be used a surface active agent such as a coating aid, a permeability improving agent for a processing liquid or the like, a defoaming agent, or a material for controlling a variety of physical properties of a photosensitive material, such as various kinds of those of anion type, cation type, non-ion type or amphoteric type. Effective antistatic agents include a diacetyl cellulose, a styrene perfluoralkyl sodium maleate copolymer, an alkali salt of a reactant prepared by the interaction of p-aminobenzene sulfonic acid and a styrene-maleic acid anhydride copolymer. Matting agents include, for example, methyl polymethacrylate, polystyrene, an alkali-soluble polymer, and the like; and a colloidal silicon oxide may further be used. Latexes to be added for improving the physical properties of a layer include, for example, a copolymer of an acrylic acid ester, a vinyl ester or the like and a monomer having other ethylene group. Gelatin plasticizers include, for example, glycerol and a glycol compound. Thickening agents include, for example, a styrene-sodium maleate copolymer, an alkylvinyl ether-maleic acid copolymer and the like.

Bases (supports) relating to this invention include, for example, a glass plate, a cellulose acetate film, a cellulose nitrate film, a polyvinylacetal film, a polypropylene film, a polyester film such as a polyethylene terephthalate film, a polystyrene film and the like. These bases may suitably be selected in accordance with the purposes or the forms of the use.

These bases may be sublayered if occasion demands.

A variety of coating methods may be used for coating the component layers of a photosensitive material relating to the invention. For example, they include, for example, an impregnation method, on air-knife method, a curtain method, and an extrusion method using such a hopper as described in U.S. Pat. No. 2,681,294. Simultaneous double or multiple layer coating may also be made, if preferred, in such a method as described in U.S. Pat. No. 2,761,791 or British Pat. No. 837,095.

EFFECTS OF THE INVENTION

According to this invention, an optimum characteristic curve can be obtained by making a good use of the characteristics of at least three kinds of emulsions so as to meet the conditions of a region to be subjected to diagnose.

According to this invention, the exposure latitude ranges of both high density and low density regions can be satisfied at the same time, so that an X-ray photosensitive material capable of displaying a high diagnosability can be provided and particularly the defects of the conventional types of X-ray photosensitive materials caused in chest X-ray photography can be eliminated, and, in addition, an X-ray photosensitive material improved in a pressure desensitization can be provided.

DESCRIPTION OF THE PREFERRED EMBODIMENTS

Now, this invention will further be described with reference to the following preferred embodiments thereof and it is to be understood that this invention shall not be limited to the embodiments.

EXAMPLE 1

In a single-jet method and a full-ammonia method, a twinned-crystal type silver iodobromide emulsion E-1 containing silver iodide of 2 mol % and having an average grain size of 1.03 μm and $s/\bar{r}=0.28$ was prepared. Emulsion E-2 similar to E-1 was also prepared except that the average grain size thereof was 1.5 μm, and $s/\bar{r}=0.25$. And, Emulsion E-3 similar to E-1 was further prepared except that the average grain size thereof was 0.5 μm and $s/\bar{r}=0.32$.

Next, in a controlled double-jet method, two kinds of monodisperse silver iodobromide emulsion containing silver iodide of 2 mol % were prepared. One emulsion E-4 comprising rounded hexahedral perfect-crystals was so prepared as to have the average grain size of 0.65 μm and $s/\bar{r}=0.162$, and the other emulsion E-5 was prepared in the same manner as in E-4, except that the average grain size was 1.18 μm and $s/\bar{r}=0.123$.

The above-mentioned emulsions were gold sulfur-sensitized under the optimum conditions, respectively.

Each X-ray photosensitive material sample was prepared respectively in such a manner as shown in Table-1 that each of the emulsions was mixed in a prescribed combination, and each of the mixture thereof was added with additives, which are known in the industry skilled in the art, such as stabilizer, antifoggant, coating aid and the like in the same quantity, and each of the mixed emulsion was coated on the both surfaces of a polyethyleneterephthalate base so that the amount of silver can be 73 mg per $dm^2$, respectively. These samples interposed between two sheets of intensifying screen for regular type use were exposed to X-rays through an aluminium wedge at 90 KVP of a tube voltage and 100 mA of a tube current for 0.06 seconds. The exposed samples were developed with an automatic processor, QX-1200 Model manufactured by Konishiroku Photo Ind. Co., Ltd., Japan, using a developer, which is the same developer as described in page 3. The obtained characteristic curves I-(1), I-(2), and I-(3) are shown in FIG. 1. The characteristic curve I-(3) relating to this invention proves that the speed is high, the expression in a toe portion is satisfactory, a region between the density values of 1 and 2 provides a favorable gamma value and the region can be expressed sharply. In I-(2) which used only the polydisperse emulsions in combination, the gamma values are lowered markedly, and in I-(1), the information of the toe portion becomes unsatisfactory.

TABLE 1

| | Mixture Proportion (by weight) | | | | | |
|---|---|---|---|---|---|---|
| Curve No. | E-1 | E-2 | E-3 | E-4 | E-5 | |
| I-(1) | 100 | — | — | — | — | For Comparison |
| I-(2) | 50 | 20 | 30 | — | — | For Comparison |
| I-(3) | — | 20 | — | 30 | 50 | This Invention |

EXAMPLE-2

Figure 2:
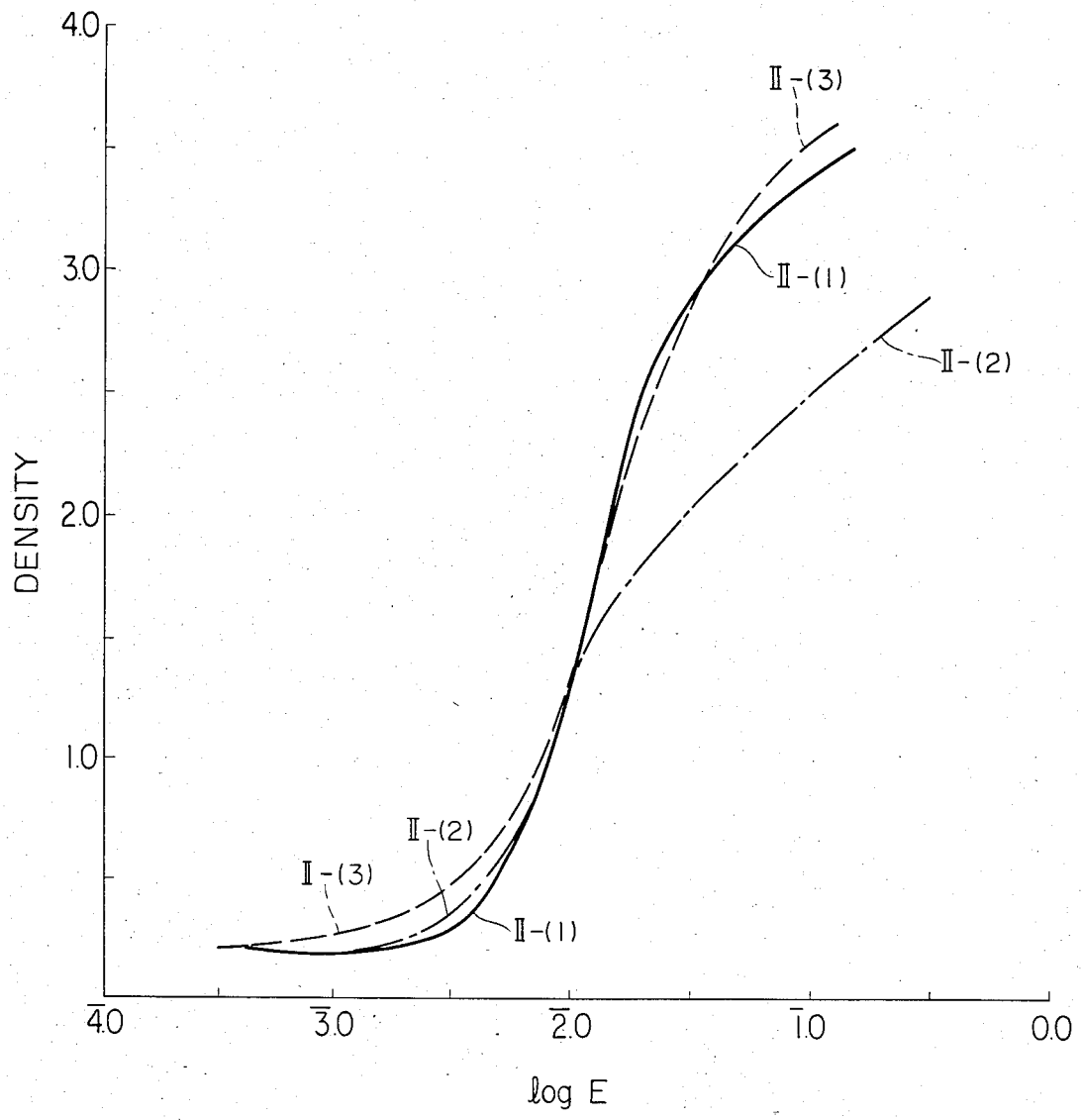
FIGS. 2 and 3 show the characteristic curves of the samples prepared in Example-2 and Example-3, respectively.

FIG. 2 illustrates the respective characteristic curves, II-(1), II-(2) and II-(3) of an emulsion given in Example-1 in which two kinds of monodisperse emulsions are used in combination, another emulsion given in Example-1, in which two kinds of polydisperse emulsions are used in combination and a further emulsion of this invention given in Example-1, in which three kinds of emulsions are used in combination. Table-2 illustrates every combinations of the emulsions and the proportion of every mixture of the emulsions.

The characteristic curve II-(3) of the emulsion of this invention proves to have a satisfactorily high speed in the foot region and a high gamma value of from 1.0 to 2.5 in density, and the characteristic curve is an ideal one for medical use.

TABLE 2

| | Mixture Proportion (by weight) | | | | | |
|---|---|---|---|---|---|---|
| Curve No. | E-1 | E-2 | E-3 | E-4 | E-5 | |
| II-(1) | — | — | — | 25 | 75 | For Comparison |
| II-(2) | 60 | — | 40 | — | — | For Comparison |
| II-(3) | — | 20 | — | 30 | 50 | This Invention |

EXAMPLE-3

Figure 3:
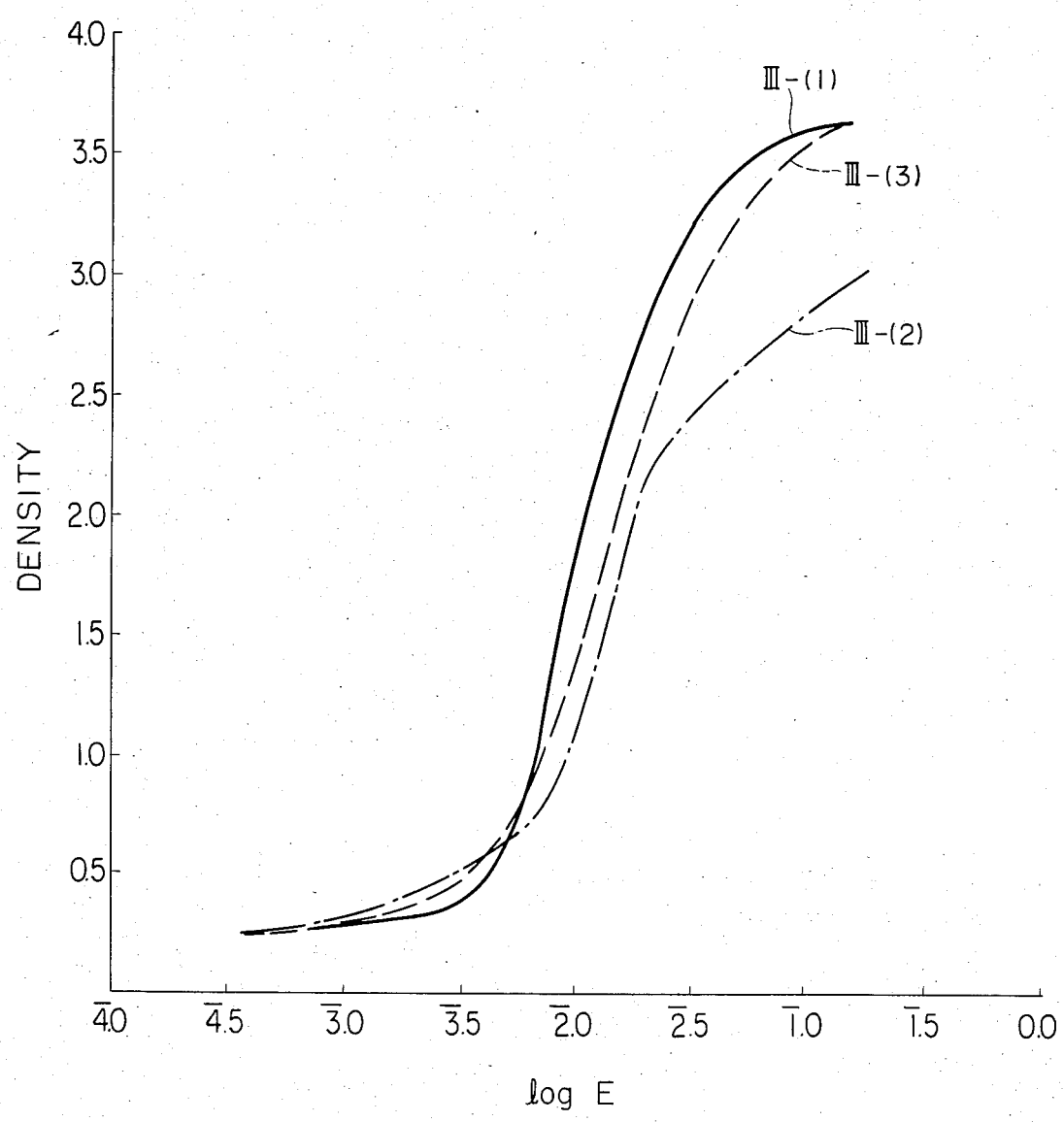
Figure 4:
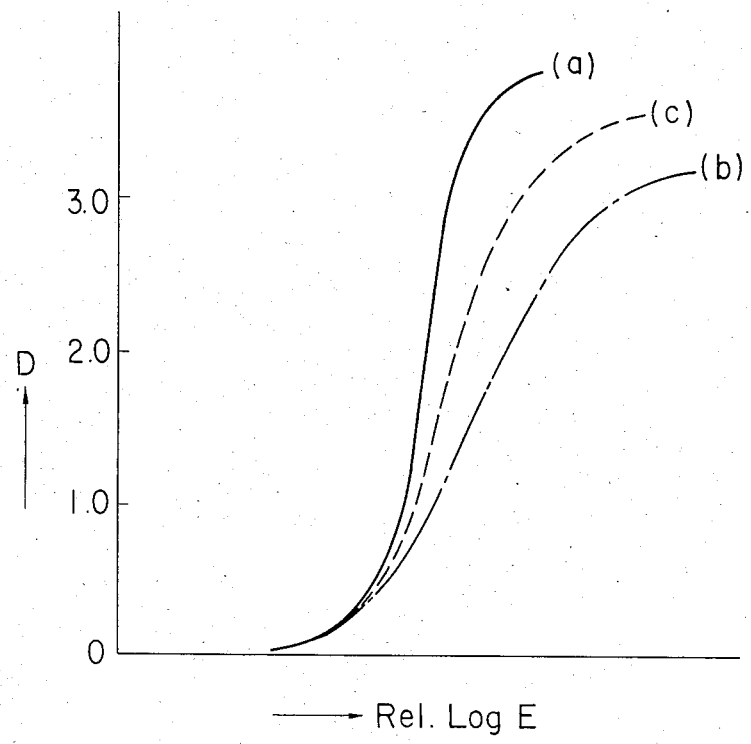
FIG. 4 show the characteristic curves of a high-gamma type (a), a low-gamma type (b) and a medium-gamma type (c) of the conventional X-ray photosensitive materials described in this specification, respectively.
Figure 5:
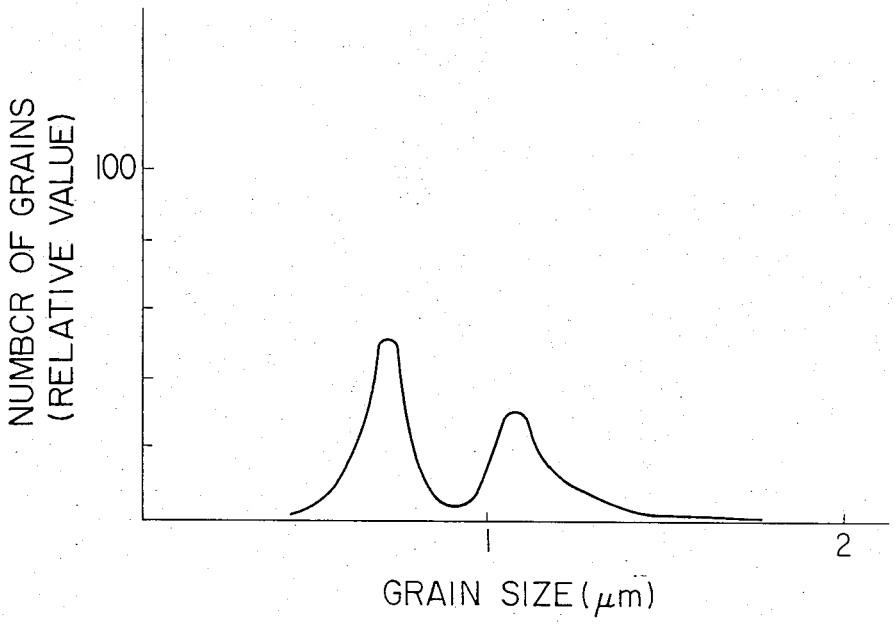
FIG. 5 show the grain-size distribution curve of the emulsion grains in the photosensitive material sample No. 19 prepared in Example-4 that is a typical embodiment of this invention.

FIG. 3 illustrates the characteristic curves of the respective emulsions given in Example-1, in which the combination thereof and the mixture proportion thereof were changed as shown in Table-3. It is easy to change a characteristic curve freely by changing a mixture proportion as shown in Table-3.

TABLE 3

| | Mixture Proportion (by weight) | | | | |
|---|---|---|---|---|---|
| Curve No. | E-2 | E-4 | E-5 | E-3 | |
| III-(1) | 10 | 30 | 60 | — | For Comparison |
| III-(2) | 30 | — | 50 | 20 | For Comparison |
| III-(3) | 20 | 30 | 50 | — | This Invention |

EXAMPLE-4

Silver iodobromide monodisperse emulsion in regular octahedral form having the average grain size of 1.05 μm was prepared in the manner that a potassium bromide solution containing potassium iodide of 2.0 mol % and an ammoniacal silver nitrate solution were added in an aqueous gelatin solution in a double-jet method with increasing the flow rate. Further, the emulsion was covered with pure silver bromide shells by adding an ammoniacal silver nitrate solution and a potassium bromide solution in a double-jet method. In course of the process, the pAg was kept at 10.0 and the pH was gradually lowered from 9.0 to 8.0. The emulsion thus obtained is called Emulsion [A]. Emulsion [A] was a perfectly crystallized monodisperse emulsion in octahedral form having the average grain size of 1.25 μm and $s/\bar{r}=0.15$.

On the other hand, Emulsion [B] was prepared by treating a silver iodobromide emulsion having the same halide composition as in Emulsion [A] in a normal precipitation method. This Emulsion [B] was a twinned crystal type polydisperse emulsion having the average grain size of 1.25 μm (i.e., 15% by number of grains were made oversize by not less than 40% of the average grain size.

A solution containing 12 g of gelatin, 0.3 g of potassium bromide and 720 cc of water and being kept at 70° C. was added at the same time with a solution containing 36 g of silver nitrate in 240 cc of water and a solution containing 25.4 g of potassium bromide in 240 cc of water by taking 30 seconds, and then an Ostwald ripening process was applied, and thereby an emulsion comprising fine and tabular shaped grains was obtained.

To the emulsion was added further with an aqueous silver nitrate solution and an aqueous potassium bromide solution containing potassium iodide of 2.0 mol % in a double-jet method. In course of adding these solutions, the pAg and pH values were kept at 0.8 and 2.0, respectively. The obtained tabular shaped grains were 1.65 μm in the average grain size and 12.0 in the ratio of the thickness to the grain size. The twinned crystal emulsion thus obtained is called Emulsion [C], (i.e., 13% by number of grains will be made oversize by not less than 40% of the average grain size).

Further, a perfectly crystallized octahedral monodisperse emulsion of 1.65 μm in the average grain size and $s/\bar{r}=0.13$ was prepared in the same process as taken in Emulsion [A]. The emulsion thus obtained is hereinafter called Emulsion [D].

Still further, a twinned crystal type polydisperse emulsion (hereinafter called Emulsion [E] of 1.65 μm in the average grain size was prepared in the same process as taken in Emulsion [B]. (In Emulsion [E], 18% by number of grains will be made oversize by not less than 40% of the average grain size.).

Finally, a perfectly crystallized octahedral monodisperse emulsion, (hereinafter called Emulsion [F]), of 0.70 μm in the average grain size and $s/\bar{r}=0.12$ was prepared in the same process as taken in Emulsion [A].

After desalting, these emulsions were gold-sensitized and sulfur-sensitized and were then stabilized by adding 4-hydroxy-b-methyl-1,3,3*a*,7-tetrazaindene, so that these emulsions were selectively mixed as shown in Table-4. After each of the emulsions was added with general type of additives for photographic use such as a spreading agent, a hardener and the like, the emulsions were coated respectively on the both surfaces of a blue-dyed and sublayered polyethyleneterephthalate film base so that the amount of silver may be 30 mg per 100 $cm^2$, and dried. Thus, the sample (Nos. 1–17) of photosensitive materials for X-ray photographic use were prepared.

Sensitometry of each of these samples was made under the aforementioned processing conditions N. The processor used was a roller-transport type automatic processor, Model New QX-1200 manufactured by Konishiroku Photo Ind. Co., Ltd., Japan.

The evaluation values of the sharpness were expressed by the values of 1.0, 1.5, 2.0 lines per mm on the respective optical transfer function (OTF) curves. The measurement of the OFT of each sample was made in such a manner that an OTF measurement chart having thereon lead-made rectangular waveforms of from 0.8 to 10 lines per mm was brought into contact with the back surface of a fluorescent screen on this side and an exposure was made to X-rays so that a total density of both sample surfaces of the regions remaining uncovered with the lead-made rectangular waveforms may be 1.0, and the back side emulsion layer was pealed off, and the waveformed pattern on the other surface was measured by scanning perpendicularly to the rectangular waveforms with a Sakura Microdensitometer Model M-5 manufactured by Konishiroku Photo Ind. Co., Ltd., Japan. The aperture size at this time was 230 μm in the parallel direction by 25 μm in the perpendicular direction, and the magnification ratio was 100 times.

When evaluating an exposure latitude, an optical density was expressed by the logarithmic exposure difference between a fog density plus 0.05 and the fog density plus 0.30.

On the other hand, a pressure desensitization was measured as follows:

Each sample was kept constant for about 12 hours, at the temperature of 25° C. and at the relative humidity of 50%, and under these conditions it was bent at an angle of about 280° C. Three minutes after it was bent, an exposure was made to light through an optical wedge for $10^{-2}$ seconds by means of a tungsten light source, and was processed similarly to the aforementioned process with Developer-1.

The pressure desensitization was evaluated as follows:

After obtaining the results of blackened density at several points between 0.5 and 1.5 of the blackened density, the density difference between a pressure-desensitized area caused by bending and an area unbent is designated by D, and the ΔD was divided by each of the density D so as to obtain an average value ΔD/D. This average value was used as the standard of pressure desensitization caused by bending. Accordingly, the less this value is, the less a pressure desensitization is.

Table-4 shows the results thereof.

TABLE 4

| Sample No. | Mixture Proportion (%) of Emulsions [A] | [B] | [C] | [D] | [E] | [F] | Gamma 1 D = 0.5–1.5 | Gamma 2 D = 0.05–0.30 | OTF (lines/mm) 1.0 | 1.5 | 2.0 | Exposure Latitude D = 0.05–0.30 | Pressure Desensitization ΔD/D |
|---|---|---|---|---|---|---|---|---|---|---|---|---|---|
| 1 | 100 | 0 | 0 | 0 | 0 | 0 | 3.50 | 0.89 | 0.96 | 0.76 | 0.55 | 0.28 | 0.30 |
| 2 | 0 | 100 | 0 | 0 | 0 | 0 | 2.80 | 0.76 | 0.94 | 0.71 | 0.47 | 0.33 | 0.18 |
| 3 | 90 | 0 | 10 | 0 | 0 | 0 | 3.15 | 0.39 | 0.96 | 0.75 | 0.53 | 0.64 | 0.20 |
| 4 | 90 | 0 | 0 | 10 | 0 | 0 | 3.10 | 0.42 | 0.95 | 0.74 | 0.51 | 0.59 | 0.22 |
| 5 | 90 | 0 | 0 | 0 | 10 | 0 | 3.12 | 0.40 | 0.95 | 0.74 | 0.51 | 0.62 | 0.20 |

TABLE 4-continued

| Sample No. | Mixture Proportion (%) of Emulsions [A] | [B] | [C] | [D] | [E] | [F] | Gamma 1 D = 0.5–1.5 | Gamma 2 D = 0.05–0.30 | OTF (lines/mm) 1.0 | 1.5 | 2.0 | Exposure Latitude D = 0.05–0.30 | Pressure Desensitization ΔD/D |
|---|---|---|---|---|---|---|---|---|---|---|---|---|---|
| 6 | 80 | 0 | 20 | 0 | 0 | 0 | 2.90 | 0.47 | 0.95 | 0.73 | 0.50 | 0.53 | 0.18 |
| 7 | 80 | 0 | 0 | 20 | 0 | 0 | 2.80 | 0.56 | 0.94 | 0.71 | 0.47 | 0.45 | 0.20 |
| 8 | 80 | 0 | 0 | 0 | 20 | 0 | 2.86 | 0.51 | 0.94 | 0.72 | 0.48 | 0.49 | 0.18 |
| 9 | 0 | 90 | 10 | 0 | 0 | 0 | 2.55 | 0.38 | 0.92 | 0.68 | 0.42 | 0.65 | 0.16 |
| 10 | 0 | 90 | 0 | 10 | 0 | 0 | 2.50 | 0.42 | 0.90 | 0.65 | 0.37 | 0.60 | 0.19 |
| 11 | 0 | 90 | 0 | 0 | 10 | 0 | 2.53 | 0.40 | 0.91 | 0.66 | 0.40 | 0.63 | 0.17 |
| 12 | 0 | 80 | 20 | 0 | 0 | 0 | 2.30 | 0.46 | 0.89 | 0.64 | 0.38 | 0.54 | 0.15 |
| 13 | 0 | 80 | 0 | 20 | 0 | 0 | 2.21 | 0.56 | 0.86 | 0.59 | 0.30 | 0.45 | 0.16 |
| 14 | 0 | 80 | 0 | 0 | 20 | 0 | 2.25 | 0.51 | 0.88 | 0.62 | 0.35 | 0.49 | 0.14 |
| 15 | 70 | 0 | 30 | 0 | 0 | 0 | 2.60 | 0.50 | 0.93 | 0.68 | 0.42 | 0.50 | 0.19 |
| 16 | 70 | 0 | 0 | 30 | 0 | 0 | 2.52 | 0.57 | 0.92 | 0.65 | 0.39 | 0.44 | 0.19 |
| 17 | 70 | 0 | 0 | 0 | 30 | 0 | 2.55 | 0.53 | 0.91 | 0.67 | 0.41 | 0.47 | 0.18 |
| 18 | 60 | 0 | 0 | 0 | 20 | 20 | 2.50 | 0.52 | 0.91 | 0.68 | 0.37 | 0.50 | 0.12 |
| 19 | 60 | 20 | 0 | 0 | 0 | 20 | 2.53 | 0.40 | 0.87 | 0.58 | 0.30 | 0.55 | 0.13 |
| 20 | 60 | 0 | 20 | 0 | 0 | 20 | 2.51 | 0.38 | 0.90 | 0.60 | 0.41 | 0.58 | 0.12 |

As is abviously understandable from Table-4, the sample Nos. 18, 19 and 20 each relating to this invention can display the excellent characteristics against pressure desensitization.

EXAMPLE-5

Emulsion [G] was prepared similarly to Emulsion [A] of Example-4, except only that the pAg was kept at 9.0. Emulsion [G] was a cubic monodisperse emulsion having the average grain size of 1.25 μm and $s/\bar{r}=0.13$.

Emulsion [G] and Emulsions [B] through [F] were chemically sensitized similarly to the case of Example-4 and were added with a variety of additives. Then, the mixed emulsions shown in Table-5 were multilayered on both surface of a blue-dyed polyethyleneterephthalate film base as shown also in Table-5, and Samples Nos. 21 through 37 of photosensitive materials for X-ray photographic use were thus prepared.

The sensitometry, image quality and pressure desensitization of each of these samples were evaluated as in Example-4, and the results thereof are shown in Table-5.

As is obviously understandable from Table-5, Sample Nos. 35, 36 and 37 each can display the excellent characteristics against pressure desensitization.

What is claimed is:

1. A negative silver halide X-ray photosensitive material comprising a support bearing thereon a silver halide emulsion layer comprising at least three kinds of silver halide emulsions whose sensitivity and gradiation are substantially different from each other, wherein out of at least three kinds of said silver halide emulsions, at least one of them is a monodisperse emulsion $E_1$ being substantially responsible for an effective density range of from 20% up to 80% of the maximum value of effective density of a characteristic curve for the photosensitive material, at least another one of the silver halide emulsions is a polydisperse emulsion $E_2$ being substantially responsible for an effective density range of from 0 to 25% of the maximum value of effective density of the characteristic curve, and at least another one of the silver halide emulsions is a low-speed emulsion.

2. A silver halide X-ray photosensitive material as claimed in claim 1, wherein said polydisperse emulsion $E_2$ has an average grain size of from 0.8 μm to 3 μm.

TABLE 5

| Sample No. | Mixture Proportion (%) of Emulsions [G] | [B] | [C] | [D] | [E] | [F] | Multicoat Upper emulsion | Lower emulsion | Gamma 1 D = 0.5–1.5 | Gamma 2 D = 0.05–0.30 | OTF (lines/mm) 1.0 | 1.5 | 2.0 | Exposure Latitude D = 0.05–0.30 | Pressure Desensitization ΔD/D |
|---|---|---|---|---|---|---|---|---|---|---|---|---|---|---|---|
| 21 | 100 | 0 | 0 | 0 | 0 | 0 | — | — | 3.53 | 0.89 | 0.96 | 0.76 | 0.55 | 0.28 | 0.28 |
| 22 | 0 | 100 | 0 | 0 | 0 | 0 | — | — | 2.80 | 0.76 | 0.94 | 0.71 | 0.47 | 0.33 | 0.18 |
| 23 | 80 | 0 | 20 | 0 | 0 | 0 | F | C | 2.96 | 0.47 | 0.95 | 0.74 | 0.51 | 0.53 | 0.18 |
| 24 | 80 | 0 | 0 | 20 | 0 | 0 | F | D | 2.91 | 0.57 | 0.93 | 0.71 | 0.48 | 0.44 | 0.19 |
| 25 | 80 | 0 | 0 | 0 | 20 | 0 | F | E | 2.93 | 0.52 | 0.94 | 0.73 | 0.50 | 0.48 | 0.18 |
| 26 | 80 | 0 | 20 | 0 | 0 | 0 | C | F | 2.90 | 0.45 | 0.95 | 0.73 | 0.50 | 0.55 | 0.17 |
| 27 | 80 | 0 | 0 | 20 | 0 | 0 | D | F | 2.85 | 0.54 | 0.93 | 0.69 | 0.47 | 0.46 | 0.18 |
| 28 | 80 | 0 | 0 | 0 | 20 | 0 | E | F | 2.87 | 0.44 | 0.94 | 0.71 | 0.49 | 0.57 | 0.17 |
| 29 | 0 | 80 | 20 | 0 | 0 | 0 | B | C | 2.38 | 0.47 | 0.90 | 0.65 | 0.39 | 0.53 | 0.15 |
| 30 | 0 | 80 | 0 | 20 | 0 | 0 | B | D | 2.33 | 0.58 | 0.88 | 0.63 | 0.36 | 0.43 | 0.16 |
| 31 | 0 | 80 | 0 | 0 | 20 | 0 | B | E | 2.36 | 0.53 | 0.89 | 0.64 | 0.38 | 0.47 | 0.14 |
| 32 | 0 | 80 | 20 | 0 | 0 | 0 | C | B | 2.27 | 0.45 | 0.88 | 0.63 | 0.37 | 0.55 | 0.14 |
| 33 | 0 | 80 | 0 | 20 | 0 | 0 | D | B | 2.23 | 0.54 | 0.86 | 0.61 | 0.33 | 0.46 | 0.15 |
| 34 | 0 | 80 | 0 | 0 | 20 | 0 | E | B | 2.25 | 0.49 | 0.87 | 0.62 | 0.35 | 0.51 | 0.13 |
| 35 | 60 | 0 | 0 | 0 | 20 | 20 | G, E | F | 2.50 | 0.51 | 0.91 | 0.68 | 0.38 | 0.50 | 0.11 |
| 36 | 60 | 20 | 0 | 0 | 0 | 20 | G, B | F | 2.53 | 0.40 | 0.88 | 0.59 | 0.31 | 0.55 | 0.12 |
| 37 | 60 | 0 | 20 | 0 | 0 | 20 | G, C | F | 2.52 | 0.37 | 0.90 | 0.60 | 0.42 | 0.58 | 0.12 |

3. A silver halide X-ray photosensitive material as claimed in claim 1, wherein said monodisperse emulsion $E_1$ has an average grain size of from 0.5 μm to 2 μm.

4. A silver halide X-ray photosensitive material as claimed in claim 1, wherein the speed of said polydisperse emulsion $E_2$ is rated as from 130 to 300, provided that the speed of said monodisperse emulsion $E_1$ is regarded as 100.

5. A silver halide X-ray photosensitive material as claimed in claim 4, wherein the speed of said polydisperse emulsion $E_2$ is rated from 110 to 300, provided that the speed of said monodisperse emulsion $E_1$ is regarded as 100.

6. A silver halide X-ray photosensitive material as claimed in claim 1, wherein a gamma value $\gamma_1$ determined by the effective density points of 0.50 and 1.50 on the characteristic curve is from 2.7 to 3.3, and a gamma value $\gamma_2$ determined by the effective density points of 0.05 and 0.30 on the characteristic curve is from 0.36 to 0.65.

7. A silver halide X-ray photosensitive material as claimed in claim 1, wherein the variation coefficient relating to the grain sizes of said monodisperse emulsion $E_1$ is not more than 0.20.

* * * * *